US008073186B2

(12) United States Patent
Milot et al.

(10) Patent No.: US 8,073,186 B2
(45) Date of Patent: Dec. 6, 2011

(54) LOUDSPEAKER

(75) Inventors: Gilles Milot, Paris (FR); Francois Malbos, Paris (FR)

(73) Assignee: Harman Becker Automotive Systems GmbH, Karlsbad (DE)

( * ) Notice: Subject to any disclaimer, the term of this patent is extended or adjusted under 35 U.S.C. 154(b) by 638 days.

(21) Appl. No.: 12/174,483

(22) Filed: Jul. 16, 2008

(65) Prior Publication Data

US 2008/0279414 A1 Nov. 13, 2008

Related U.S. Application Data

(62) Division of application No. 10/860,260, filed on Jun. 3, 2004, now Pat. No. 7,418,107.

(30) Foreign Application Priority Data

Jun. 4, 2003 (EP) ..... 0321333

(51) Int. Cl.
*H04R 1/00* (2006.01)
*H04R 7/00* (2006.01)

(52) U.S. Cl. ..... 381/398; 381/392

(58) Field of Classification Search ..... 181/171, 181/172; 381/392, 398, 396, 400, 403, 404, 381/412–415, 419–421, 423, 424
See application file for complete search history.

(56) References Cited

U.S. PATENT DOCUMENTS

| | | | | |
|---|---|---|---|---|
| 3,684,052 | A | 8/1972 | Sotome | |
| 5,847,333 | A * | 12/1998 | D'Hoogh | 181/171 |
| 5,949,898 | A | 9/1999 | Proni | |
| 6,171,534 | B1 | 1/2001 | Leach et al. | |
| 6,243,479 | B1 * | 6/2001 | Proni | 381/420 |
| 6,351,544 | B1 | 2/2002 | Noll | |
| 6,568,503 | B2 | 5/2003 | Proni | |
| 6,728,389 | B1 | 4/2004 | Bruney | |
| 7,039,213 | B2 * | 5/2006 | Hyre et al. | 381/414 |
| 7,418,107 | B2 | 8/2008 | Milot et al. | |
| 2005/0013461 | A1 | 1/2005 | Milot et al. | |

FOREIGN PATENT DOCUMENTS

| | | | |
|---|---|---|---|
| EP | 0 556 786 | A2 | 2/1993 |
| EP | 0 556 786 | A3 | 2/1993 |
| EP | 0 963 136 | A2 | 5/1999 |
| EP | 0 963 136 | A3 | 12/1999 |

* cited by examiner

*Primary Examiner* — Brian Ensey

(57) ABSTRACT

A loudspeaker including a frame, a movable diaphragm that oscillates, and a suspension for mounting the diaphragm to the frame, where the suspension comprises a flexible surround having a substantially enclosed space where at least a portion of the flexible surround is air permeable.

21 Claims, 5 Drawing Sheets

A

LOUDSPEAKER

PRIORITY CLAIM

This application is a divisional application of U.S. application Ser. No. 10/860,260, filed Jun. 3, 2004, and European Application No. EP 03291333.7, filed on Jun. 4, 2003, both of which are herein incorporated by reference.

BACKGROUND OF THE INVENTION

1. Technical Field

This application relates to a loudspeaker and, in particular, to a loudspeaker comprising a frame, a movable diaphragm that oscillates around a position of rest, and a suspension for mounting the diaphragm to the frame, in which the suspension comprises a flexible surround portion defining an enclosed space where at least a portion of the flexible surround portion is air-permeable.

2. Related Art

Loudspeakers may be constructed of a diaphragm, a moving voice coil secured to the diaphragm in a central area, a magnet motor gap system into which the moving voice coil is inserted with the coil being centered in the gap of the magnet motor system, a frame supporting the magnet system and enclosing the diaphragm on one half side of the diaphragm, and a suspension system.

In a cone loudspeaker, the guiding of the movable diaphragm may be achieved by a double mechanical guiding or suspension system. The suspension system may be comprised of two elements, a flexible deformable surround (front or outer suspension) that is secured to the frame in an edge area of the diaphragm and the spider (rear suspension) that guides the oscillation movement of the moving voice coil and of the diaphragm mounted to the coil. The excursion of the moving system may be limited by the maximum mechanical deformation of the spider. The stiffness of the suspension system is the sum of the stiffness of the flexible surround portion and of the stiffness of the spider.

Surrounds can be constructed from several materials including rubber, compressed foam rubber, corrugated cloth, paper, plastic, and the like. Often the word "roll" is used in place of "surround" when describing the front suspension. Roll surrounds have a single, large, semi-circular corrugation typically constructed from rubber, compressed foam rubber or treated fabric. Surrounds help keep the diaphragm centered and provide a portion of the restoring force that keeps the voice coil in the motor magnet gap. In addition to controlling the linear motion of the cone, the surround also acts as a major centering force for the loudspeaker's voice coil. This centering force prevents the voice coil and former from rocking and rubbing against the pole piece or top plate. The surround also provides a damped termination for the edge of the cone. The choice of thickness and material type for surround construction can alter the response of the loudspeaker.

The spider, that may be constructed from treated corrugated fabric, also keeps the voice coil centered, as well as providing a portion of the restoring force that maintains the voice coil within the gap. The stiffness of the spider can affect the loudspeaker's resonance. The spider also provides a barrier for keeping foreign particles away from the gap area.

Surrounds may be one of the limiting factors in designing long-excursion loudspeakers. Excursion is defined as the amount of linear length the diaphragm body can travel. With small roll diameters, the excursion may be limited by the surround's physical limits. Larger surrounds may have an attendant loss in effective diaphragm area for a loudspeaker of given outside diameter, thus, creating an inevitable trade-off. Excursion and cone area are two factors which contribute to a loudspeaker's volume displacement. The higher the volume displacement capability of a loudspeaker, the greater the loudspeaker's ultimate low frequency output potential can be.

Furthermore, loudspeakers may be divided into several categories. Loudspeakers that are designed to produce low frequencies are referred to as "woofers." In these loudspeakers, the diaphragm is large and has a large range of excursion. Loudspeakers that are designed to produce high frequencies are referred to as "tweeters." Tweeters may comprise smaller diaphragms that oscillate at a smaller range of excursion. Loudspeakers that are designed for medium frequencies are referred to as "mediums." For these different kinds of loudspeakers different magnet systems and different guiding systems have been used.

Woofers, for example, may comprise a conically shaped diaphragm and a double mechanical guiding system including the surround portion and a spider. This double mechanical guiding system is used to properly guide the oscillating voice coil even at maximum excursions. Tweeters, in which the excursions of the moving diaphragm and the associated voice coil may be smaller, the use of spiders for the guiding system may not be necessary and the guiding system may consist only of a flexible surround portion.

Suspension systems may suffer from several drawbacks. For example, the linearity of the spider may not be very good due to parasite hysteresis effects and as the mechanical properties of the spider fatigue during use. In addition, the linearity of the flexible surround portion for fixing the diaphragm to the frame may not be very good as the geometry of the suspension may not be symmetric. In this instance, the oscillation around the position of rest may produce different restoring forces in an anterior and posterior direction.

Thus, to obtain a loudspeaker having a good sound quality, it is desirable that the suspension system be linear; in other words, that the restoring force be directly proportional to the excursion. Furthermore, it is desirable that the suspension system be symmetric, i.e., an excursion in the posterior and anterior direction of the loudspeaker should have the same restoring forces. However, the mechanical behavior of the suspension system at maximum excursions may be difficult to control because a good compromise between the linearity of the spider and the restoring force at maximum excursion is difficult to obtain. The loudspeaker may operate in a closed or vented box. At larger excursions of the moving system, the internal pressure in the box may modify the geometry of the flexible surround portion and may create acoustical distortions.

Symmetrical suspension systems have been attempted that include a diaphragm that is supported at its marginal edge on the frame by means of a surround that consists of an angular, hollow member of rubber-like flexible material that is substantially circular shape in cross-section. This surround is connected at its inside periphery to the marginal edge of the diaphragm and at its outside periphery to the frame. This hollow surround has several drawbacks. First, the surround forms a closed space in which air is contained. In circumstances in which the loudspeakers are exposed to the sun or subjected to heat, for example in a vehicle, the expansion of the heated air inside the closed surround may damage the surround. As the air volume within the surround depends on the temperature of the air inside the surround, the sound quality of the loudspeaker depends on the ambient temperature of the loudspeaker. In addition, this system is not linear. At high excursions of the diaphragm, the air in the closed box is much more compressed, resulting in higher restoring forces at maximum excursions of the voice coil.

Therefore, there is a need to provide a loudspeaker having a substantially linear and symmetrical suspension system, which improves the sound quality of the loudspeaker.

SUMMARY

This application relates to loudspeakers comprising a frame, a movable diaphragm that oscillates around a position of rest, and a suspension system, including a flexible surround, for mounting the diaphragm to the frame. In particular, this application relates to loudspeakers having an open suspension system in which a portion of the flexible surround is air-permeable. The open suspension system may comprise a single or multiple piece flexible surround that defines an enclosed space where at least a portion of the flexible surround is air-permeable. For example, the surround may comprise two surround portions that form an enclosed space between the portions. Either the first or second portion of the surround may be air permeable. Alternatively, the surround may comprise a single piece structure defining an enclosed space. Air permeability may be provided to the first or second surround portion by means of holes or other perforations in the first or second surround portion. Alternatively, the material from which the first or second surround portion is made may be air permeable.

The air-permeability of a portion of the surround of the suspension system may create a pneumatic air leak in the enclosed space defined between the first and the second flexible surround portions. Due to this air permeability, the air between the two flexible surround portions is not completely enclosed so that, during the oscillation movement of the diaphragm, the flexible surround portions may follow the oscillation movement of the diaphragm more easily, resulting in reduction in the stiffness of the suspension system at high excursions and improved the linearity and symmetry of the diaphragm in its axial movement, thereby decreasing distortions and improving the acoustic quality of the loudspeaker.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

This application relates to loudspeaker diaphragm suspension systems. In particular, this application relates to a loudspeaker diaphragm system comprising a frame, a movable diaphragm that oscillates around a position of rest, and a suspension system for mounting the diaphragm to the frame.

The suspension system comprises a flexible surround defining an enclosed space where at least a portion of the flexible surround defining the enclosed space is air-permeable. The air-permeability of the flexible surround decreases the stiffness of the suspension system at high excursions and improves the linearity and symmetry of the diaphragm in its axial movement, thereby decreasing distortions and improving the acoustic quality of the loudspeaker.

In loudspeakers, the guiding of the movable diaphragm may be achieved by a double mechanical guiding or suspension system. The suspension system may be comprised of two elements, a flexible deformable surround (front or outer suspension) that is secured to the frame in an edge area of the diaphragm and the spider (rear suspension) that guides the oscillation movement of the moving voice coil and of the diaphragm mounted to the coil. Surrounds may be constructed from any material known in the art that provides the requisite function, for example, rubber, compressed foam rubber, corrugated cloth, paper, plastic, and the like. Often the word "roll" is used in place of "surround" when describing the front suspension. Roll surrounds may have a single, large, semi-circular corrugation or annular space typically constructed from rubber, compressed foam rubber or treated fabric. Surrounds help keep the diaphragm centered and provide a portion of the restoring force that keeps the voice coil in the motor magnet gap.

Figure 1:
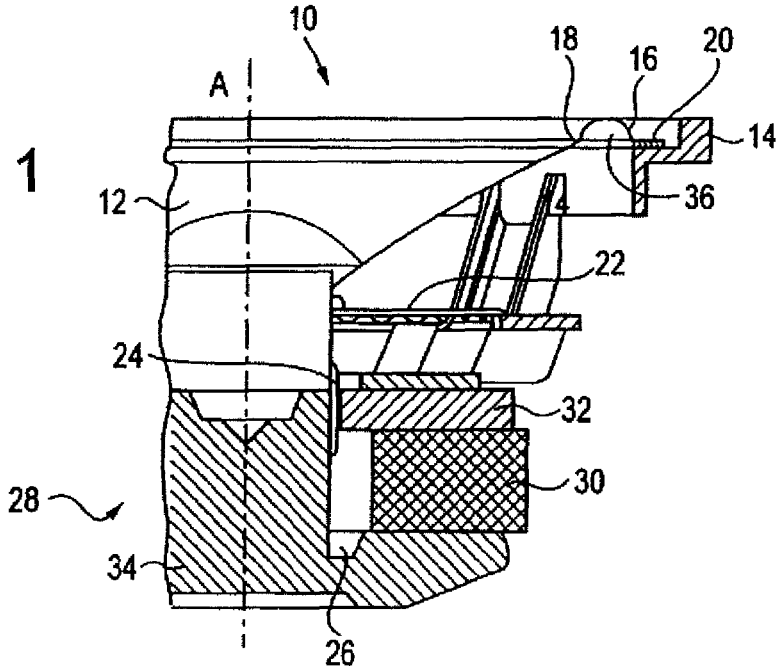
FIG. 1 is a cross-sectional view of a portion of a loudspeaker including a loudspeaker suspension system.

FIG. 1 shows a typical cone loudspeaker in cross-section. Loudspeaker 10 comprises a diaphragm 12 which is mounted to a frame 14. Diaphragm 12 is mounted to the frame 14 by a surround 16. The surround 16 may be annularly shaped having an inner peripheral edge 18 and an outer peripheral edge 20. The loudspeaker 10 further comprises a spider 22 for guiding the oscillation movement of the diaphragm 12 and a voice coil 24 which is inserted into an air gap 26 of a magnet system 28. The magnet system 28 may comprise a permanent magnet 30 which, as shown in FIG. 1, is annularly shaped. On the anterior side of the permanent magnet 30 a polar piece 32 may be provided for guiding the magnetic flux of the permanent magnet 30. On the posterior side of the permanent magnet 30 another polar piece 34, which has an extension 36 near the axis A of the loudspeaker, may be provided. The voice coil 24 oscillates in the air gap 26 between the polar pieces 32 and 34 in accordance with the current flowing in the coil windings. The voice coil 24 is mounted to the diaphragm 12, so that the diaphragm 12 oscillates in accordance with the current in the coil 24. In the structure shown in FIG. 1, the oscillation movement of the diaphragm 12 may damped down due to particular construction of the loudspeaker suspension system. The inner peripheral edge 18 of the surround 16 may be attached to the diaphragm's 12 outer peripheral edge by any means known to one skilled in the art, for example with adhesive. The outer peripheral edge 20 of the surround 16 may be attached to the frame 14 in a similar manner. As shown in FIG. 1, surround 16 may comprise a roll 36 or annular space.

Figure 4:
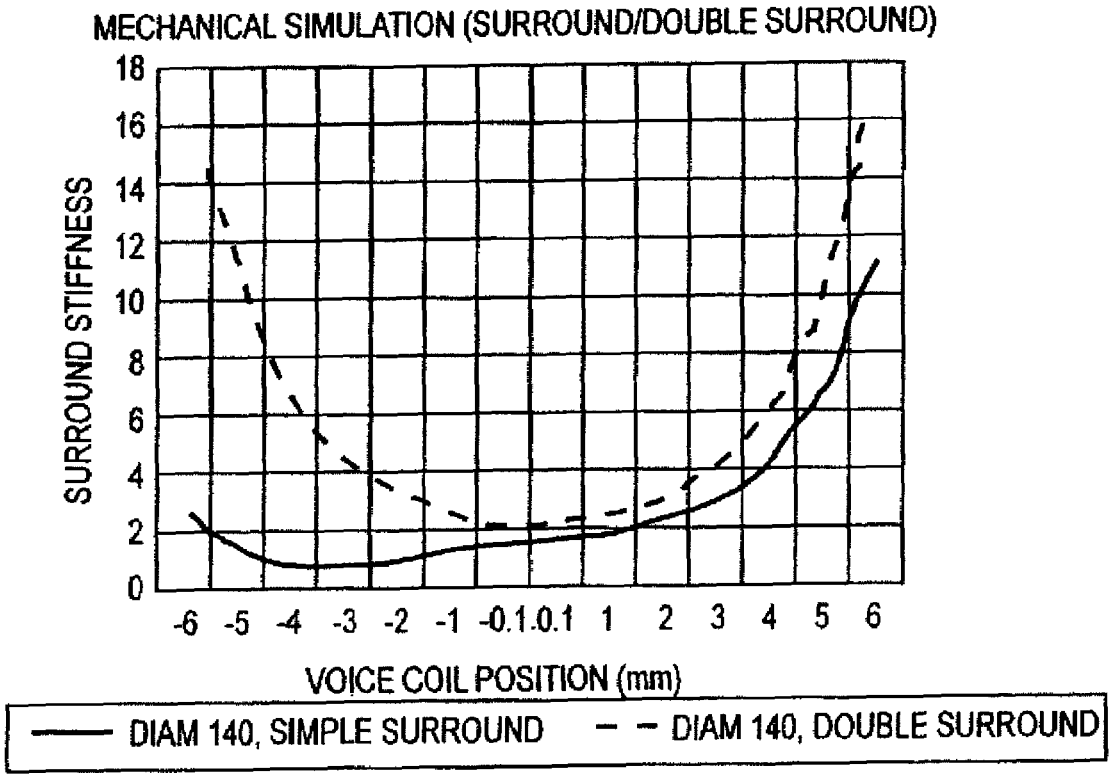
FIG. 4 shows the results of a simulation of the surround portion stiffness/displacement characteristic of a surround system including single or double surround portion.

In FIG. 4, the surround stiffness of the loudspeaker suspension system having a single flexible surround portion of FIG. 1 is shown for different coil positions of the loudspeaker. The continuous, unbroken line reflects the stiffness of a suspension system shown in FIG. 1. As shown in FIG. 4, the stiffness of the suspension is not symmetrical. In other words, a positive or negative excursion of the coil does not produce the same effects on the diaphragm.

Figure 2:
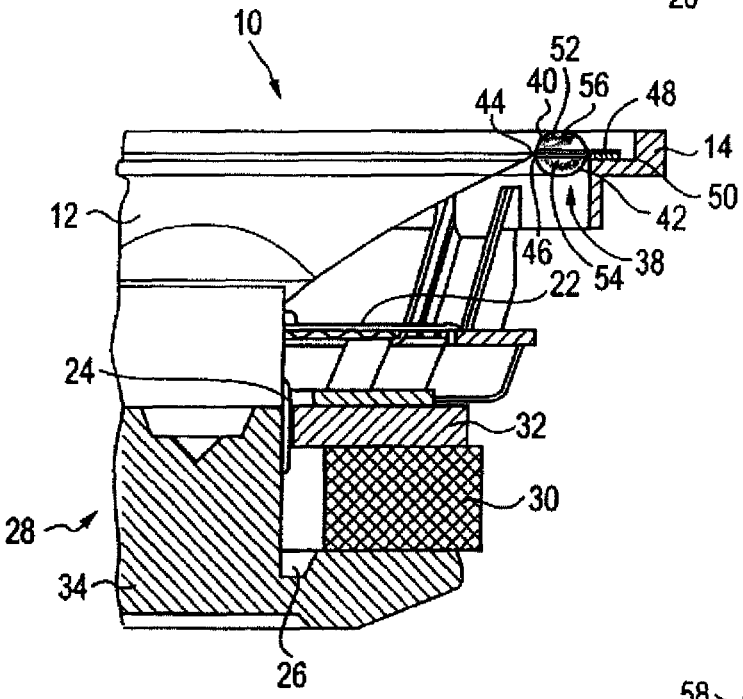
FIG. 2 is a cross-sectional view of a portion of a loudspeaker suspension system including first and second surround portions.

In FIG. 2, a loudspeaker 10 is shown in partial cross-section Loudspeaker 10 comprises a diaphragm 12 which is mounted to a frame 14. Diaphragm 12 is mounted to the frame 14 by a surround 38. The loudspeaker 10 further comprises a spider 22 for guiding the oscillation movement of the diaphragm 12 and a voice coil 24 which is inserted into an air gap 26 of a magnet system 28. The magnet system 28 may comprise a permanent magnet 30 which, as shown in FIG. 2, is annularly shaped. On the anterior side of the permanent magnet 30 a polar piece 32 may be provided for guiding the magnetic flux of the permanent magnet 30. On the posterior side of the permanent magnet 30 another polar piece 34, which has an extension 36 near the axis A of the loudspeaker, may be provided. The voice coil 24 oscillates in the air gap 26 between the polar pieces 32 and 34 in accordance with the current flowing in the coil windings. The voice coil 24 is mounted to the diaphragm 12, so that the diaphragm 12 oscillates in accordance with the current in the coil 24.

As shown in FIG. 2, the diaphragm 12 is attached to the frame 14 by a surround 38. Surround 38 may comprise a single piece of material or multiple pieces of material. As shown in FIG. 2, surround 38 may comprise two annular rings each having an internal peripheral edge 44, 46 and an outer peripheral edge 48, 50. The internal edge 44 of the first surround portion 40 may be attached to the upper edge or rim area of the diaphragm 10. The outer edge 48 of the first surround portion 40 may be attached to the outer edge 50 second surround portion 42. Alternatively, the outer edge 48 of the first surround portion 40 may be attached directly to the frame 14, for example, the outer edge 48 of the first surround portion 40 may be attached to a protrusion on the frame 14. The inner edge 46 of the second surround portion 42 may be attached to under edge or rim area of the diaphragm 10. The second surround portion 42 may be, at its outer edge 50, attached to the frame 14 of the loudspeaker 10. Surround 38 may also be a single flexible ring having a first surround portion 40 and a second surround portion 42 and an internal peripheral edge and an external peripheral edge. In this configuration, the internal edge may be attached to the outer peripheral edge of the diaphragm and the outer peripheral edge of the surround may be attached to the frame in a manner similar to that shown in FIG. 1.

As shown in FIG. 2, the first and second surround portions 40, 42 may each comprise a roll or channel 52, 54, which may be concentric with the flexible surround. The channel 52 of the first surround portion 40 may be convex in its orientation relative to the diaphragm and frame of the loudspeaker and the channel 54 of the second surround portion 42 may be concave in its orientation relative to the diaphragm and frame of the loudspeaker such that an enclosed space 56 formed by the channels 52, 54 between the first surround portion 40 and the second surround portion 42. The closed space 56 may be of any suitable configuration.

As shown in FIG. 2, the closed space 56 may be an annular tube. The enclosed space 56 may also have an angular shape. The two surround portions may be arranged symmetrically with regard to each other. Further, the surround portions may be arranged symmetrically to an axis defined by the junction of the surround portions to the diaphragm and by the junction of surround portions to the frame.

Figure 3:
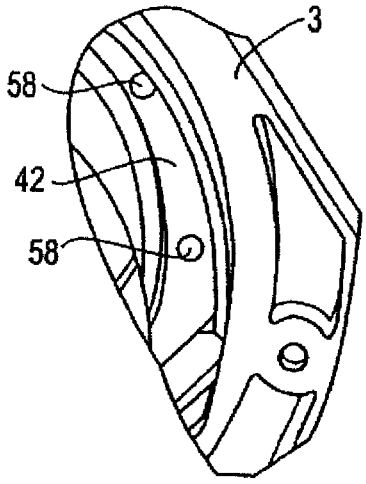
FIG. 3 is a portion of the suspension system of FIG. 2 showing the second surround portion having holes.

The suspension system comprising the flexible surround portions 42, 44 may be vented. For example, one or the other of the first or second surround portions 42, 44 may be air permeable to establish a pneumatic air leak in the closed spaced 56 defined between the first and second surround portions 56. For example, as shown in FIG. 3, the second surround portion 42 is made air permeable by means of holes 58 in the second flexible surround portion 42. The holes 58 serve as a passage for the air between the first and second surround portions 40, 42, when the diaphragm 12 is oscillating. Alternatively, the first surround portion 40 may be provided with holes or perforations. Additionally, or in lieu of holes, one of the surround portions 40, 42 may comprise a porous material or otherwise air-permeable material. For example, the air-permeable surround portion may comprise an air-permeable fabric material, paper, or other such materials. The materials comprising the surround portions may be the same, or they may be different, so long as one surround portion is air-permeable and the other is not.

If the loudspeaker in which the suspension system is used works in a closed or vented box, a vented or air-permeable suspension system permits the optimization of the geometry of the suspension system, so that at high excursions of the diaphragm the acoustical surround portion distortions can be minimized because of the internal pressure of the air volume between the two flexible surround portions. The internal air volume of the surround portions avoids this deformation.

The first surround portion 40 may exert a first restoring force on the diaphragm 12 when the diaphragm 12 is oscillating and the second surround portion 44 may exert a second restoring force on the diaphragm 12 when the diaphragm 12 is oscillating, such that the resultant force from the first and the second restoring forces on the diaphragm is substantially symmetrical to the position of rest. Due to the relative symmetric arrangement of the two surround portions, a symmetry of excursion depending on the applied force around a position of rest may be obtained, and acoustical distortions may be minimized.

Figure 5:
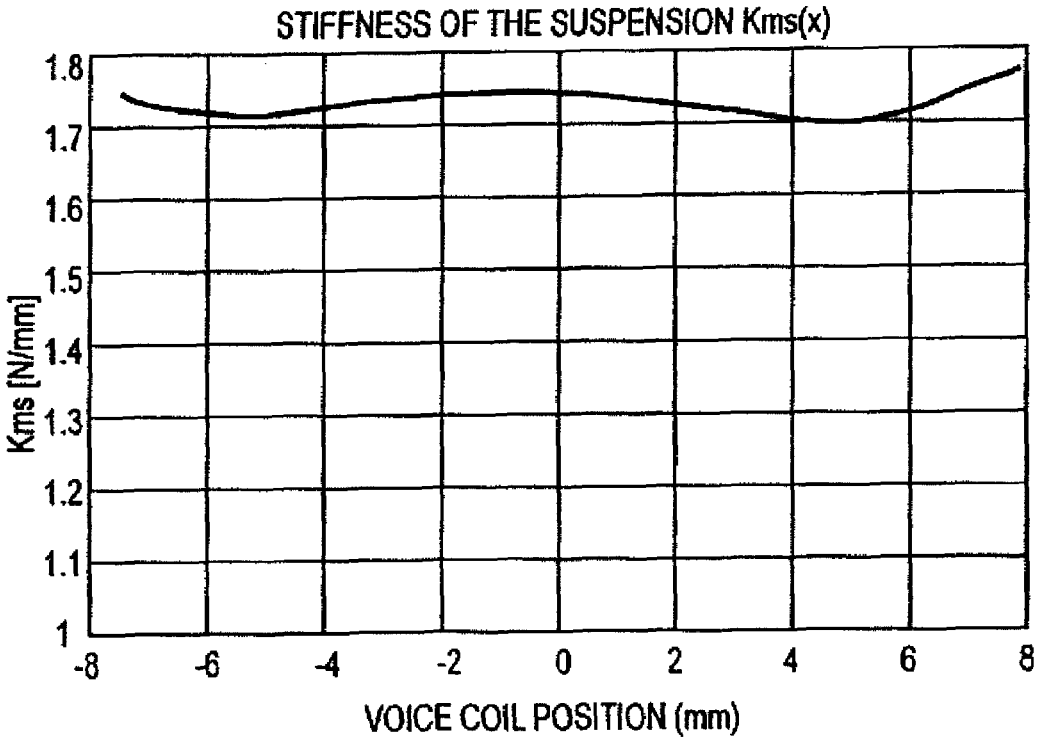
FIG. 5 shows a mechanical measurement of a stiffness/displacement characteristic of a surround system having an air-permeable second surround portion.

FIG. 4 shows the results of a simulation of a comparison of the stiffness of the suspension systems of FIGS. 1 and 2. As shown, in a loudspeaker having two surround portions in which one portion is air-permeable, the surround stiffness is substantially more symmetric (shown by the dashed lines) as compared to the surround stiffness of a loudspeaker having a single surround (shown by the solid line). As shown in FIG. 5, the air-permeability of the suspension system provides a stiffness that is substantially constant over the whole range of coil position. Furthermore, the stiffness is symmetric around the position of rest. Thus, a flat stiffness/displacement characteristic which is symmetric for larger excursions of the moving parts is obtained. These two features contribute to less distortion and improved sound quality of the loudspeaker.

The different surround portions may also assist in controlling the frequency characteristic of the loudspeaker. Due to the symmetry of the suspension, the harmonic distortions can be reduced by around 50% compared to a suspension consisting of a single non-symmetric surround portion. Furthermore, the second surround portion also provides a much wider range of control of the frequency characteristics of the loudspeaker by providing another parameter that improves the frequency characteristic.

As shown in FIG. 2, the loudspeaker may also comprise a resilient centering device, i.e., a spider 22, for centering a voice coil which drives the movable diaphragm, A spider 22 having a low stiffness and a good linearity in guiding the movement of the diaphragm 12 and of the coil 24 may be used that does not contribute to the damping down of the oscillation. Thus, even at maximal excursion of the voice coil 24, the spider 22 may substantially attenuate the oscillation movement of the voice coil 24. In other words, the spider 22 may be designed to improve the guiding of the moving system, thus having a very low stiffness.

If the spider 22 has no dampening properties, a double surround portion, system as described above, may fulfill the suspension function of a spider 22, because the pneumatic compressor effect of the air-permeable surround portion 40 or 42 allows better control of the displacement of the moving system at maximal excursions than does a spider 22, and independently of its stiffness/displacement characteristic. Thus, a spider 22 can be selected such that the dampening characteristics are obtained by the double surround system 40, 42 and the spider 22 will only guide the movement of the moving system. In this way, a suspension system shown in FIG. 2 with a better linearity and a behavior at maximal excursion may be obtained. Further, the spider 22 may be completely eliminated. This may be especially useful in cone loudspeakers used for low frequencies, which may require a spider in order to guide the movement of the diaphragm and of the voice coil.

Tweeters (high frequency) may utilize guiding systems comprising only the surround. With a double surround in which a portion of the surround is air-permeable, the spider may be eliminated in other loudspeaker systems. For example, the spider may be eliminated in a loudspeaker provided for frequency ranges down to 20 Hz.

Figure 6:
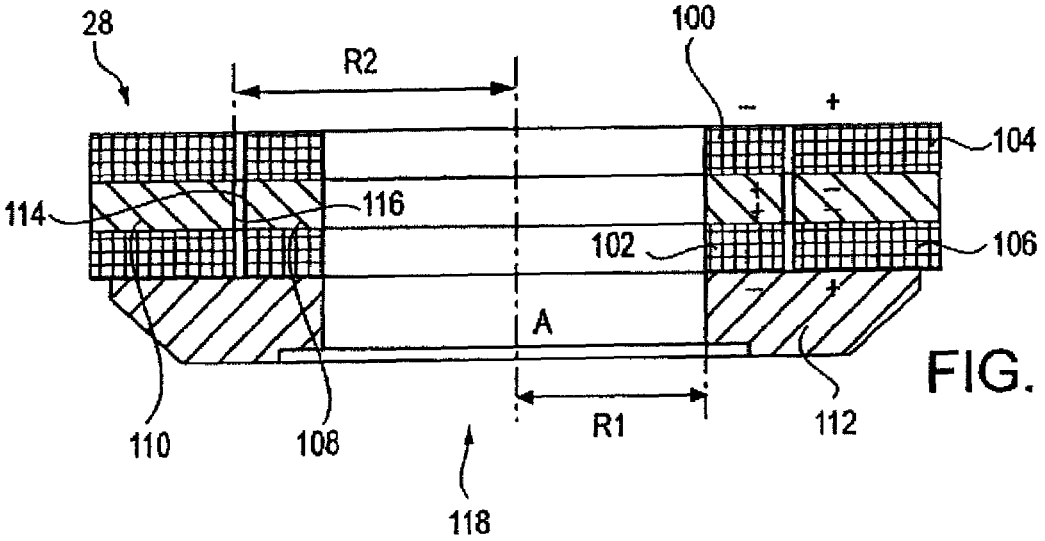
FIG. 6 is a magnet system that may be used in a loudspeaker, including the loudspeaker of FIGS. 1-3.

To obtain good sound quality, the magnetic field in which the voice coil is positioned should be as homogeneous as possible. For example, the magnetic field should be homogeneous over the whole range of excursion of the coil. In FIG. 6 a magnet system that may be used together with a loudspeaker is shown. This magnet system may provide a very homogeneous magnetic field for the coil to which the diaphragm is fixed. The magnet system 28 may comprise four annular coaxial permanent magnets 100, 102, 104 and 106. The magnetic rings may be aligned coaxially to an axis A. The permanent magnets 100 and 106 may be disposed at a first radius R1 corresponding to a first diameter D1=2R1, and the permanent magnets 102, 104 may be located at a second radius R2 corresponding to the diameter D2=2R2. The two inner and the two outer permanent magnets may be arranged geometrically and magnetically so that their geometric center axes A coincide. In the axial direction from anterior to posterior the magnetic poles of the inner two magnets are minus, plus, plus, minus. The magnetic poles from anterior to posterior of the outer permanent magnet ring is plus, minus, minus, plus. With this arrangement, uneven magnetic poles oppose each other in the radial direction. The permanent magnets, which may be any known type of magnet, for example, neodymium magnets, may sandwich at the inner diameter R1 a first annular polar piece 108 and at R2 a second annular polar piece 110. On the posterior side the magnet system 28 is terminated by a polar piece 112.

Figure 7:
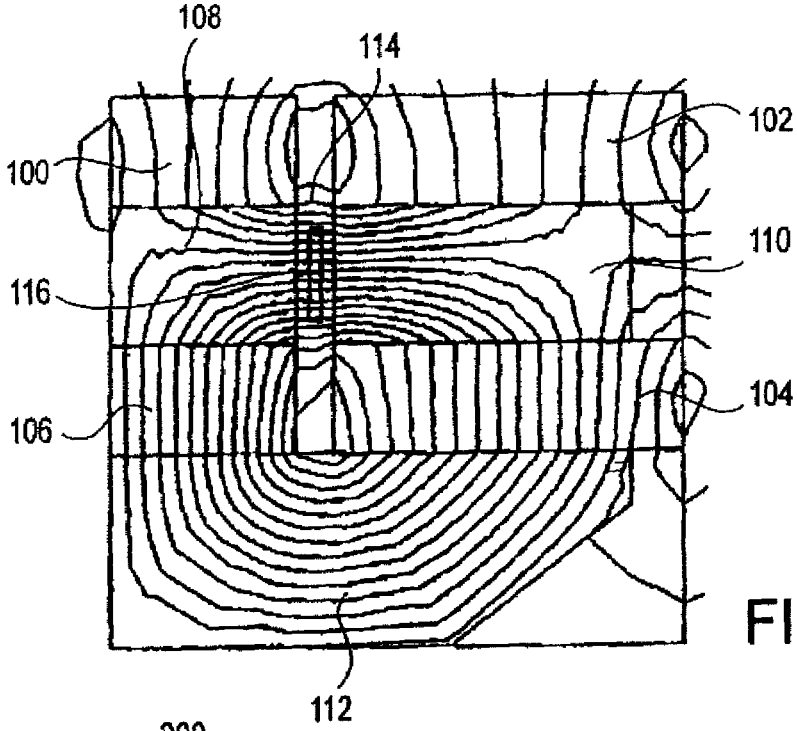
FIG. 7 shows the magnetic flux obtained by the magnet system of FIG. 6.

Between the permanent magnets 100, 102, 104 and 106, and between the polar pieces 108 and 110, an air gap 114 may be provided in which the voice coil 116 may be positioned, which may be connected to the diaphragm (not shown). In the position of rest, the voice coil 116 may be positioned in near the polar pieces 110 and 112. As shown in FIG. 7, the magnetic flux in the air gap 114, especially in the area near the coil 116, is very homogeneous, so that the oscillating coil oscillates in the homogeneous part of the magnetic field.

As shown in FIG. 6, the magnets and the polar pieces may be annular rings. A bore or decompression hole 118 with a radius R1 may be provided coaxially in the magnetic system 28. With this decompression hole 118, the back-wave irradiated by the diaphragm (not shown) may not be refracted by the magnets and the polar pieces, but may continue to travel to the posterior side of the loudspeaker. Conversely, with discs, the refracted wave would interfere with sound waves emitted to the anterior of the loudspeaker, so that the acoustic quality of the irradiated waves would be deteriorated.

The magnet system shown in FIG. 6 may also comprise a groove as disclosed in French Patent Application No. 0 201 782, filed in the name of Harman International, incorporated in its entirety herein by reference. This groove may be situated in the middle of the polar pieces 108 and/or 110 next to the voice coil. In this groove an electrically conductive ring may be provided.

Figure 8:
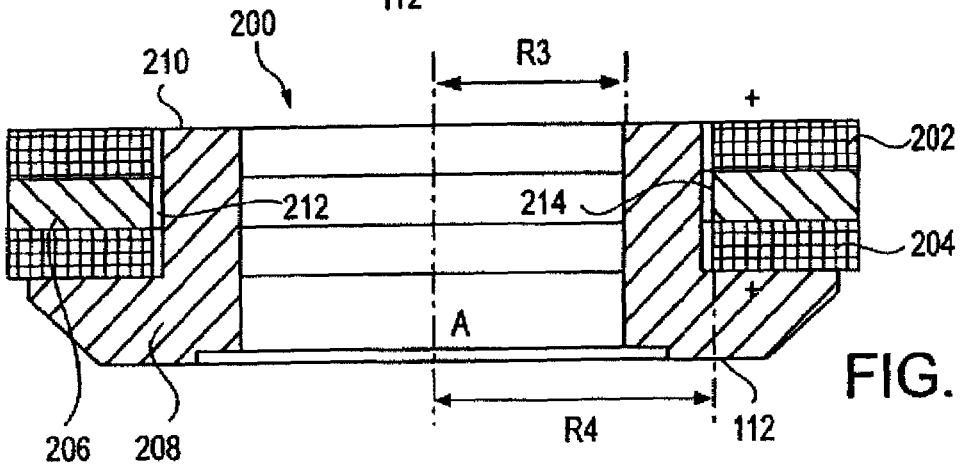
FIG. 8 shows another magnet system which may be used in a loudspeaker, including the loudspeaker of FIGS. 1-3.

Another magnet system is shown in FIG. 8. Magnet system 200 may comprise two annular permanent magnets 202, 204. A polar piece 206 may be positioned between the two permanent magnets 202, 204. A further polar piece 208 may be positioned on the posterior side of the magnet system. Polar piece 208 may comprises an extension 210 parallel to the axis, which terminates at the anterior side of the magnet system. Between the extension 210 and the polar piece 206 and the two permanent magnets 202, 204, an air gap 212 may be provided in which the voice coil 214 may be positioned. The air gap 212 may be delimited by the inner border of the polar piece 206 located at radius R2) and the magnets 202, 204 at R4 and by the outer edge of the extension 210. A homogeneous magnetic field may be obtained in the air gap 212 therefore contributing to the sound quality of the loudspeaker. Similar to the magnet system shown in FIG. 6, the magnet system shown in FIG. 8 may also comprise a decompression hole with the diameter D3=2R3. The polar piece 206 and/or the extension 210 may also be provided with a groove comprising the conductive ring as described in French Patent Application No. 0 201 782.

Figure 9:
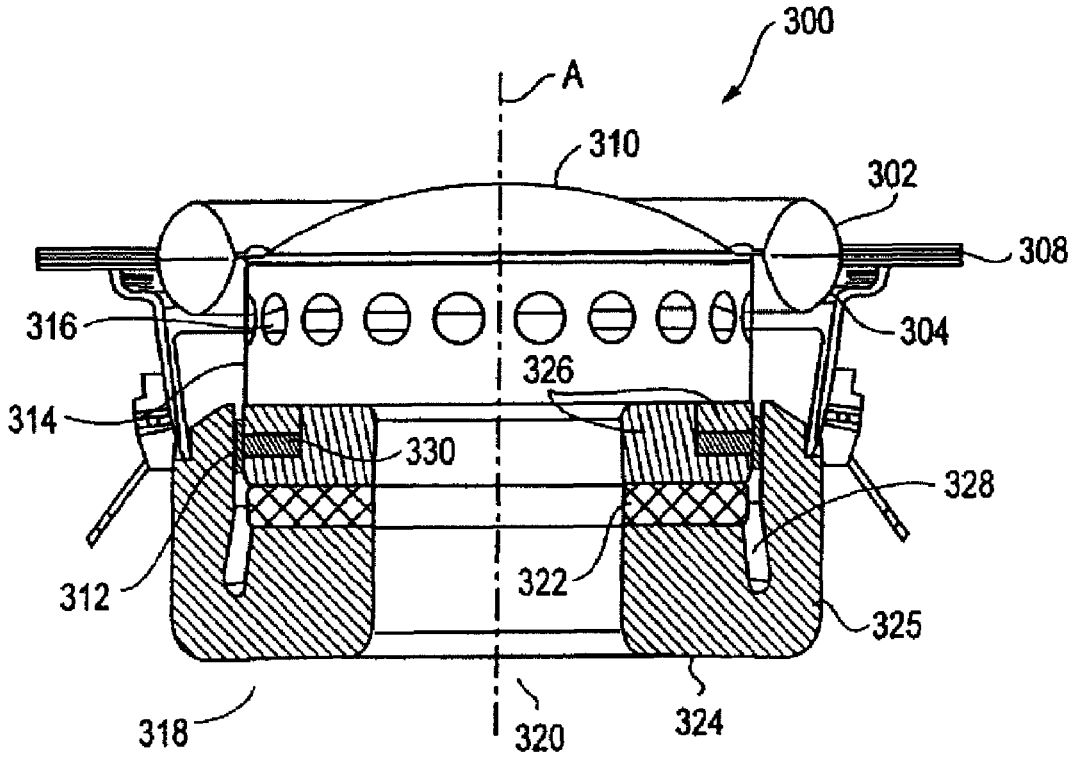
FIG. 9 is a cross-sectional view of a portion of a loudspeaker suspension system having first and second flexible surround portions that operates in the range of from about 20 Hz to about 5 kHz.

In FIG. 9, a dome loudspeaker 300 is shown. The dome loudspeaker 300 may comprise a double vented surround system, such as that shown in FIG. 2 above, comprising first surround portion 302 and a second surround portion 304. The surround portions 302, 304 may be flexible and may be constructed of any of the materials as described above. The first and the second surround portions 302, 304 may be attached to the frame 308 in the manner described above for FIG. 2. One of the surround portions may be air-permeable, for example having holes as described above and shown in FIG. 3. The surround portions 302, 304 may be attached to a diaphragm 310.

As shown in FIG. 9, the diaphragm 310 may be a dome or convex-shaped. The diaphragm 310 may be connected to the voice coil 312, for example, the voice coil 312 is connected to the diaphragm 310 by a support 314 which may comprise holes 316. The holes 316 may assist in the ventilation of the system, when the diaphragm 300 is oscillating. The magnet system 318 may comprise a decompression hole 320 that may be symmetrical to the axis A. The decompression hole 320 may prevent the diffraction of the sound wave emitted to the interior of the loudspeaker. The magnet system 318 further may comprise a permanent magnet 322 as well as at least two polar pieces 324, 326. The polar piece 324 may have an extension 325 at its outer edge which may terminate in a truncated form on the anterior side of the magnet system. An air gap 328 may be provided between the polar pieces 324, 326 and the magnet 322, in which the voice coil 312 may oscillate. A groove 330 may be provided which is filled with an electrically conducting material. Domed loudspeakers generally have been built as tweeters, i.e., for high frequencies and low excursions, as use of a spider in the magnet to system of FIG. 9 was difficult. Due to the improved guiding capabilities provided by a suspension system having a surround portions with an air-permeable portion that allows the suspension system to linearly and symmetrically guide the diaphragm and voice coil at higher excursions, a loudspeaker comprising a dome-shaped diaphragm also may be used as a boomer down to a frequency of, e.g., 20 Hz.

Figure 10:
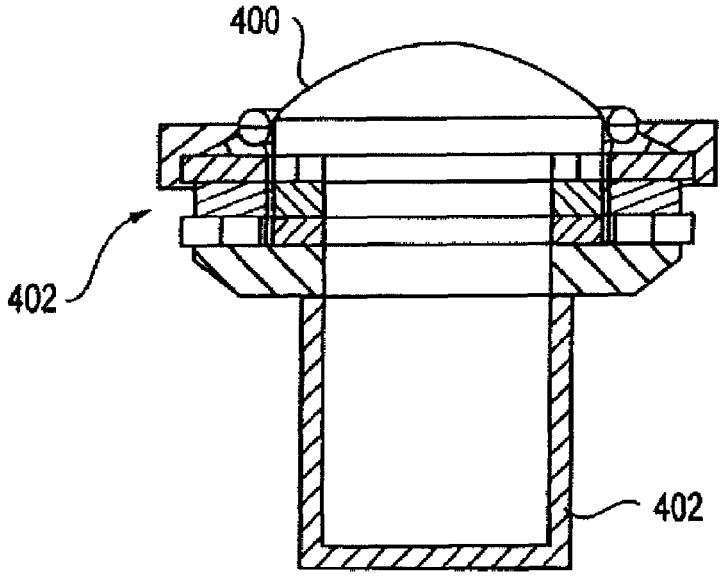
FIG. 10 is a cross-sectional view of a portion of a loudspeaker suspension system having first and second flexible surround portions that operates in the range of from about 1 kHz to about 20 kHz.

In FIG. 10 another loudspeaker is shown. The loudspeaker 60 may comprise the suspension system as described herein. The loudspeaker further may comprise a diaphragm 400 and a magnet system as shown in FIG. 6. The magnet system may comprise a decompression hole with a diameter D1, which may be terminated by a box 402 having cylindrical shape with a diameter D1. Dampening material (not shown) may be provided in the box which may attenuate the back-wave emitted to the posterior side of the loudspeaker. Due to first and second surround portions, and the air permeability of one of the portions, the loudspeaker illustrated in FIG. 10 may guiding the movement of the voice coil without a spider. The loudspeaker shown in FIG. 10 is particularly suitable for incorporation into locations where space is limited such as, for example, a dashboard of a vehicle. However, many other uses are contemplated.

Figure 11:
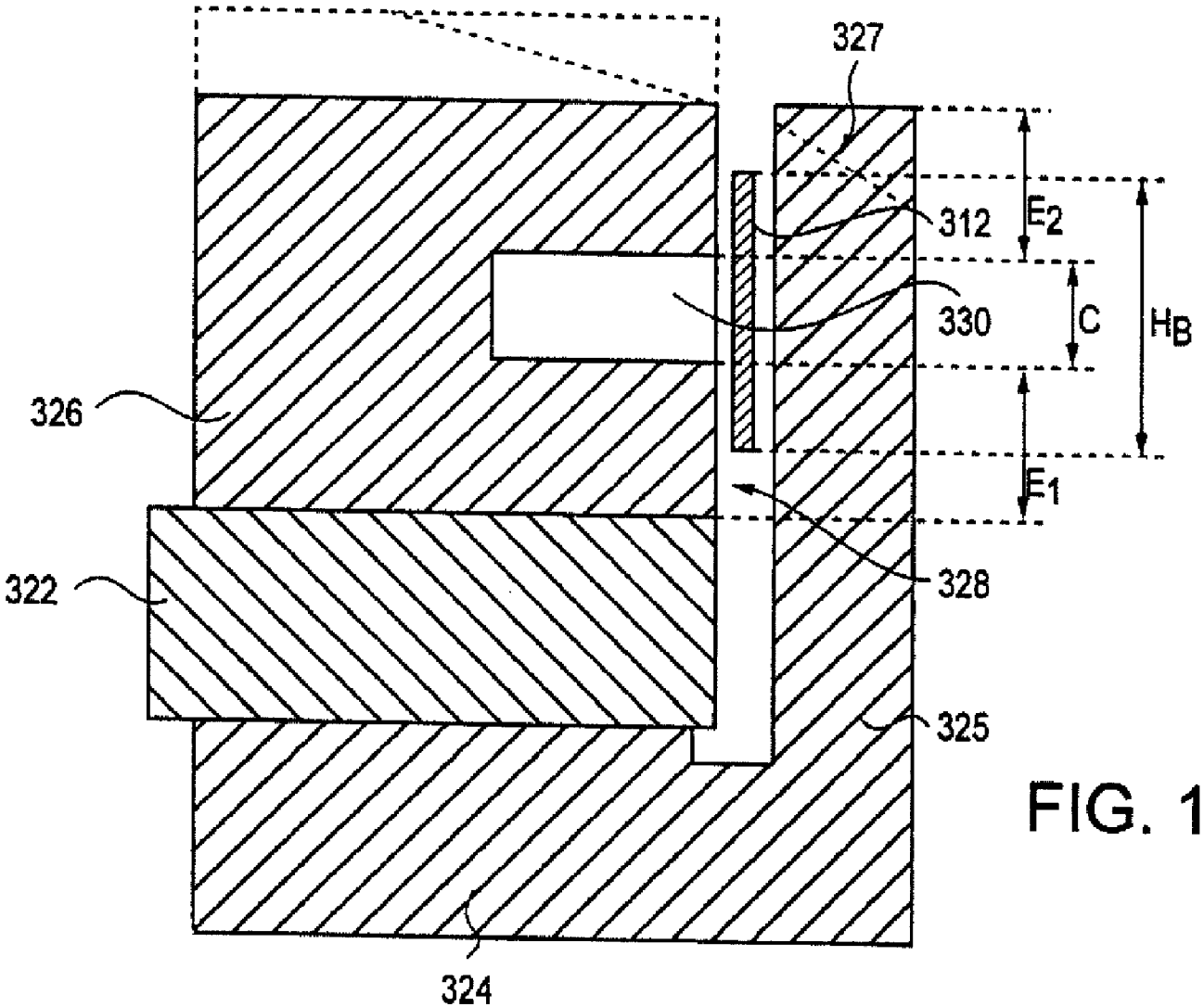
FIG. 11 shows the magnet system of the loudspeaker of FIG. 9 in further detail.

FIG. 11 illustrates the magnet system of FIG. 9 in more detail. In this magnet system the permanent magnet 322 may be positioned between the polar 324, 326. The polar piece 324 may have at its outer edge an extension 325 which terminates in a truncated form shown by the dashed line 327. The air gap 328 may be delimited by the outer radius of the polar piece 326, the outer radius of the permanent magnet 322 and by the inner radius of the extension 325 of the polar piece 324. The extension 325 may also terminate on the anterior side of the magnet system by a substantially flat plane. The polar piece 326 may comprise a groove 330 which may be arranged in the middle of the voice coil 312 and which may comprise electricity conducting material, for example, copper or carbon. The polar piece may be a one-piece element as shown in FIG. 1, but it can also be made of two separate parts as shown in FIG. 9, wherein the second part of the polar piece 326 delimits the groove 330 on the anterior side. As shown by the dashed line, the polar piece 326 may also have a truncated form.

As shown in FIG. 11, and described in French Patent Application No. 0 201 782, the voice coil may have a height HB which is smaller than E1+C+E2 and larger than C. The anterior end of the groove 330 may be positioned a distance E2 from the upper side of the polar piece 326. The groove 330, which may comprise electrically conductive material, may have a width C and end at a distance E1 of the lower side of the polar piece 326. Due to the groove 330, a homogeneous magnetic field may be obtained even if the coil 312 in the gap is oscillating.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A loudspeaker comprising:

a frame, a movable diaphragm which oscillates, a suspension system for mounting the diaphragm to the frame having a first surround portion and a second surround portion, and a magnet system where one of the first or the second surround portions is air permeable.

2. The loudspeaker of claim 1 where the magnet system comprises at least one annular permanent magnet and at least two annular polar pieces.

3. The loudspeaker of claim 2 where the magnet system comprises two inner annular coaxial permanent magnets and two outer annular coaxial permanent magnets, where the two inner annular permanent magnets are superimposed and have a first diameter D1, the two outer annular permanent magnets are superimposed and have a second diameter D2 that is larger than D1.

4. The loudspeaker of claim 3 where a polar piece is positioned between two permanent annular magnets.

5. The loudspeaker of claim 4 where the inner diameter of the permanent magnets have the opposite polarization of the outer diameter of the permanent magnets.

6. The loudspeaker of claim 5 where in the radial direction uneven magnetic poles oppose each other.

7. The loudspeaker of claim 1 comprising a decompression hole coaxial to a main axis (A) of the loudspeaker.

8. The loudspeaker of claim 7 where the diameter of the decompression hole corresponds to the inner diameter (D1) of the two inner annular permanent magnets.

9. The loudspeaker of claim 7 where the diameter (D3) of the decompression hole corresponds to the inner diameter of the inner annular polar piece.

10. The loudspeaker of claim 7 where the decompression hole is terminated by a box.

11. The loudspeaker of claim 10 where the box is cylindrical and has a diameter that corresponds to the diameter of the decompression hole.

12. The loudspeaker of claim 1 where the magnet system comprises one permanent magnet, two polar pieces, a voice coil positioned in a gap of the magnet system, and a groove that is at least partially filled with a ring of electricity conducting material, where the groove is perpendicular to the main axis of the loudspeaker.

13. A magnet system for a loudspeaker comprising:

at least two inner annular coaxial permanent magnets, at least two outer annular coaxial permanent magnets, and at least two annular polar pieces, where the two inner annular permanent magnets are superimposed and have a first diameter D1, the two outer annular permanent magnets are superimposed and have a second diameter D2 that is larger than D1.

14. The magnet system of claim 13 where a polar piece is positioned between two permanent annular magnets.

15. The magnet system of claim 14 where the inner diameter of the permanent magnets have the opposite polarization of the outer diameter of the permanent magnets.

16. The magnet system of claim 15 where in the radial direction uneven magnetic poles oppose each other.

17. The magnet system of claim 13 comprising a decompression hole coaxial to a main axis (A) of the loudspeaker.

18. The magnet system of claim 17 where the diameter of the decompression hole corresponds to the inner diameter (D1) of the two inner annular permanent magnets.

19. The magnet system of claim 17 where the diameter (D3) of the decompression hole corresponds to the inner diameter of the inner annular polar piece.

20. The magnet system of claim 17 where the decompression hole is terminated by a box.

21. The magnet system of claim 20 where the box is cylindrical and has a diameter that corresponds to the diameter of the decompression hole.

* * * * *